US006403154B1

(12) United States Patent
VerMehren

(10) Patent No.: US 6,403,154 B1
(45) Date of Patent: Jun. 11, 2002

(54) PROCESS OF APPLYING GLUE TO SHEET PRODUCTS

(76) Inventor: H. Richard VerMehren, 3865 N. Palafox St., Pensacola, FL (US) 32505

( * ) Notice: Subject to any disclaimer, the term of this patent is extended or adjusted under 35 U.S.C. 154(b) by 0 days.

(21) Appl. No.: 09/791,065

(22) Filed: Feb. 22, 2001

(51) Int. Cl.[7] ..... B05D 5/10

(52) U.S. Cl. ..... 427/208.6; 427/296; 427/348; 427/350; 427/377; 427/378; 427/391; 427/395; 427/434.3; 427/439; 428/41.8

(58) Field of Search ..... 427/296, 348, 427/350, 377, 378, 391, 395, 434.3, 439, 208.6; 428/41.8

(56) References Cited

U.S. PATENT DOCUMENTS 5,176,611 A 1/1993 VerMehren ..... 493/213

6,164,438 A 12/2000 VerMehren ..... 198/836.3

*Primary Examiner*—Bernard Pianalto
(74) *Attorney, Agent, or Firm*—Thomas, Kayden, Horstemeyer & Risley

(57) ABSTRACT

Sheet products, such as card stock, envelopes and other paper products (10) are advanced on a vacuum surface conveyor belt (30) beneath a glue applicator drum (35). The glue transfer strips (37 and 38) of the glue applicator drum apply stripes of glue (42 and 43) at the ends of the sheet product, leaving a belt engaging space (41) without glue between the glue stripes. The sheet product is grasped by overlying conveyor belts (46 and 47) at the belt engaging space (41), thereby exposing the wet glue stripes on opposite sides of the belts. Hot air is applied on opposite sides of the conveyor belts (46 and 47), drying the glue. The glue transfer strips (37 and 38) of the glue applicator drum can be adjusted in size, shape and position so as to apply glue to one end, the other end, or both ends of the sheet product, and if glue is applied to only one end, one of the dryers (50 or 51) can be deactivated, saving energy.

7 Claims, 5 Drawing Sheets

PROCESS OF APPLYING GLUE TO SHEET PRODUCTS

FIELD OF THE INVENTION

The invention involves a method and apparatus for applying glue to sheet products, such as envelopes, card stock and other flat products. More particularly, the invention involves the simultaneous application of glue to opposed ends of the sheet products.

BACKGROUND OF THE INVENTION

In the production of sheet products, such as card stock and other paper products, there are many instances when the product is to be folded, and glue is applied to the flaps so as to seal the various panels and flaps together. An example of this is in the production of envelopes, some of which require the application of glue to more than one flap of the folded product.

The conventional approach for the application of glue in an automated glue applicator machine is to feed a plurality of identical sheet products in sequence to a conveyor system. The conveyor system advances each product in spaced relationship along a processing path by controlling one end of the product while applying glue to the other end of the product. Typically, drive belts must carefully control each product so that the glue is properly applied at the precise location on the sheet product. In some instances, the glue, such as latex and remoistenable glues, are dried as the products are advanced farther along the processing path. In other instances, the glue is covered with a peel-away seal strip that can be removed from the sheet product when the panel is to be adhered to an adjacent surface.

When applying glue to the closure flaps of a series of envelopes, the typical approach is to advance the envelopes along a processing path with the fold of the flap extending parallel to the direction of movement, and with the flap folded closed as it approaches the processing path. A flap opener, in the shape of a small plow, is positioned in the path of the flap and the flap opener engages and opens the flap so as to place it in the proper path for receiving the glue. The flap opener, the gum box, the glue applicator drum and a heater that dries the adhesive after the adhesive has been applied to the envelope are all on the operator's side of the machine. The other side of the machine typically includes overlying conveyor belts that grip and advance the envelopes through the workstations along the processing path.

In those instances where glue is to be applied to both ends of a sheet product, it is customary to run the sheet product through the glue applicator twice, with the first run applying glue to one end, and then reversing the product for the second run so that the same system applies glue to the other end of the sheet product.

When the sheet product must be run through the glue applicator twice in order to apply glue to the opposed ends of the sheet product, the expense of the product increases because of the additional machine time required for the second run, and because of the extra handling and planning required by the machine operator.

In those instances where attempts are made to apply glue to both ends of the sheet products with one run through the glue applicator system, the glue applicator drum can be set up with its glue applicator strips spaced about the circumference of the cylindrical surface instead of along the length of the cylindrical surface. The glue transfer strips are positioned so as to apply glue to both ends of the sheet products during a single run; however, since the transport belts must engage at least an edge portion of the sheet products, the glue can be applied only to approximately one-half the width of the sheet products, leaving the remaining portion of the sheet product available for engagement by the transport belts. In many cases, the products of this process are unacceptable to the purchaser since the glue is not applied across the entire ends of the sheet product.

It is to the above noted concerns that this invention is directed.

SUMMARY OF THE INVENTION

Briefly described, the present invention includes a method and apparatus for simultaneously applying glue to both ends of a sheet product, drying the glue, and shingle stacking or vertical stacking the sheet products for packaging and delivery to a purchaser.

An examples of the sheet products to which the glue is to be applied can include hanger tags for coat hangers, envelopes, and virtually any card stock or other paper products or even other sheet material that has enough body strength and weight to be advanced with its body extending parallel to the direction of advancement through the system without inadvertently folding or wrinkling.

The sheet products are arranged in stacked relationship and are fed to the system by a feed wheel of conventional design. Each sheet product is deposited by the feed wheel onto an aligner conveyor that is a conventional surface conveyor having spacer pins protruding therefrom for engaging the rear edge of each product, for assuring that the trailing edge of each product is properly positioned as the product advances on through the processing path. The products are moved in sequence from the aligner section onto a vacuum surface conveyor belt where a partial vacuum beneath the belt holds each sheet product in place as the sheet products advance with the belt beneath a glue applicator drum. A gum box of conventional construction applies liquid glue to the applicator pads that are carried by the cylindrical surface of the glue applicator drum, and the applicator pads rotate into contact with the sheet product and transfer the glue to the sheet product.

The sheet products continue to move beyond the glue applicator drum on the vacuum conveyor and the vacuum conveyor delivers the sheet products to dryer belts. The dryer belts are a pair of overlying endless conveyor belts that grasp each sheet product in sequence and move the sheet products along a drying path where heated air is directed toward the glue and dries the glue.

A feature of the invention is that the glue applicator drum can be as long as the width of the machine and can apply glue to the opposed ends of the largest sheet products that can be processed through the machine. For example, the sheet product being run through the system might be card stock and it is desirable to apply glue simultaneously to both ends of the card stock. The glue transfer pads are located on the glue applicator drum in spaced relationship along the length of the cylindrical surface of the drum. The sheet products are oriented with their ends aligned across the processing path so as to accept stripes of glue at their ends from the glue transfer pads. This leaves a space on the card stock between the stripes of glue where glue has not been applied to the card stock that is later used as a belt engaging space. This space is later engaged by the overlying dryer belts that grasp the card stock without contacting the glue and continue to advance the card stock through the system.

Heated air is applied in straddling relationship with respect to the dryer belts, in the paths where the glue of the card stock will travel. Typically, the heaters comprise separate ducts that extend in straddling relationship beside the dryer belts. Blowers and induction heaters are mounted at one end of the heater ducts for supplying warm air through the ducts, and the ducts have exhaust ports at intervals along their lengths that are directed toward the paths that are to be traveled by the glue applied to the card stock.

Another feature of the invention is that the transfer strips that are carried by the cylindrical surface of the glue applicator drum can be of virtually any shape and size that is compatible with the shape and size of the work pieces to be processed through the system, including having transfer strips at only one end of the glue applicator drum. This latter configuration makes the system compatible for applying glue to only one end of a sheet product, or to only the other end of the sheet product. For example, there are some instances when glue is to be applied to the flaps of envelopes. In this situation, the glue applicator strips would be located at one end of the glue applicator drum, but the other end of the drum would be left blank. However, some envelopes are considered to be "left-handed" or "right-handed," in that the flap to which the glue is to be applied must be run on the left-hand side of the system, or on the right-hand side of the system, usually dependent upon the way that the seams are formed in the envelope. The invention disclosed herein is compatible with operating the envelopes in either a "left-handed" or "right-handed" orientation, by simply adjusting the placement of the glue applicator strips on the glue applicator drum.

Another feature of the invention is the separate heaters used to apply hot air to the glue, to dry the glue. If only one end of the sheet product is to receive glue, only one heater may be activated, thereby conserving the energy of the inactive heater.

Therefore, it is an object of this invention to provide an improved, multi-purpose glue applicator for sheet products, such as envelopes, card stock, and other paper products, which is more versatile in that it can apply glue to various configured sheet products, and which tends to avoid the need for advancing the sheet products more than once through the machine for application of glue to different surfaces of the sheet products.

Another object of the invention is to provide an improved glue applicator for sheet products which has the capacity of applying glue simultaneously to opposed ends of the sheet products.

Another object of the invention is to provide an improved glue applicator for sheet products that includes the ability to apply glue to one end, or to the other end, or to both ends of a sheet product, and then to dry only those ends of the sheet product to which glue has been applied.

Other objects, features and advantages of the present invention will become apparent upon reading the following specification, when taken in conjunction with the accompanying drawings.

DETAILED DESCRIPTION OF THE INVENTION

Figure 1:
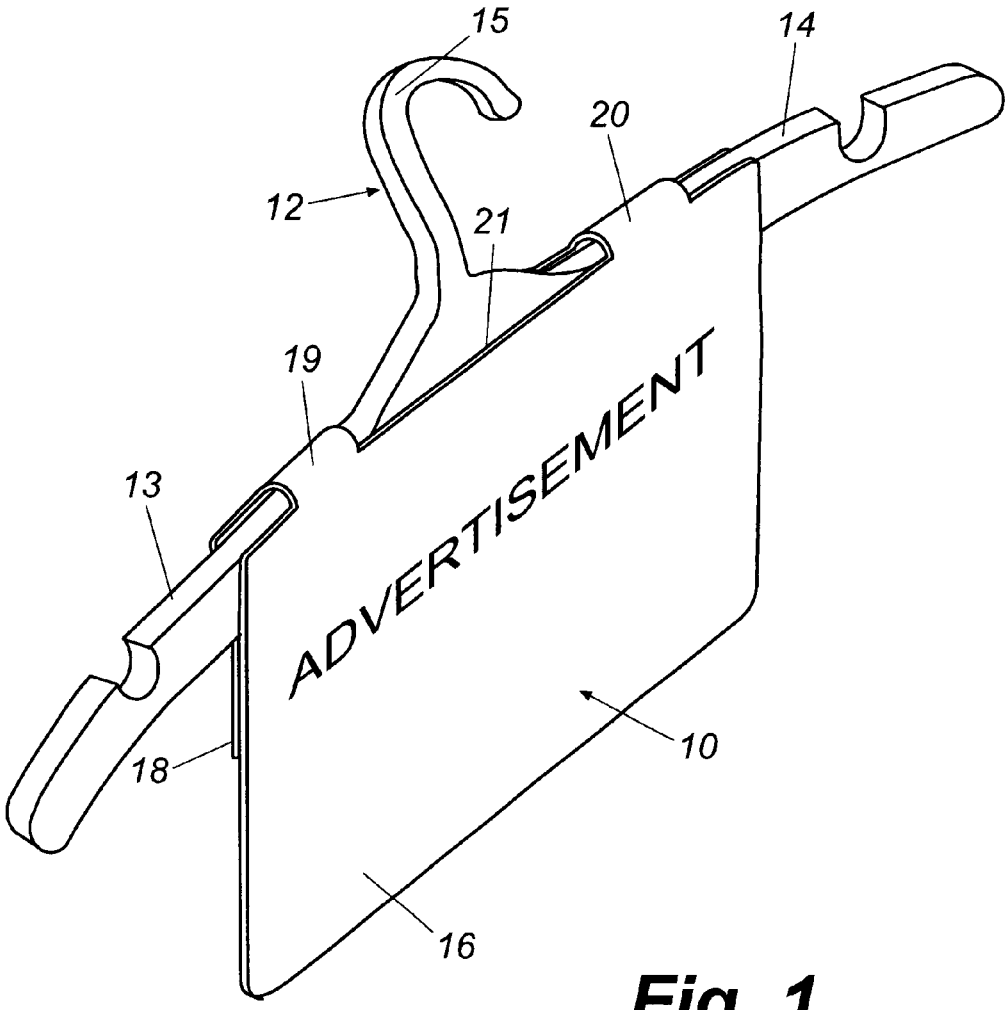
FIG. 1 is a perspective illustration of a hanger tag formed of card stock, which has been produced on a single run through the multi-purpose glue applicator.

Referring now in more detail to the drawings, in which like numerals indicate like parts throughout the several views, FIG. 1 discloses a hanger tag 10 for attachment to a garment hanger 12. The garment hanger is of the type that can be utilized for supporting upper body garments for females, such as brassieres or other upper body garments that have shoulder straps. Hangar tags can be applied to garment hangars of other configurations. The garment hanger includes shoulder bars 13 and 14 and hook 15.

The hanger tag 10 is formed of a single sheet of folded over card stock, including a front panel 16, rear panel 18, and connector straps 19 and 20 extending between the front and rear panels. The connector straps define a slot 21 extending therebetween. Facing surfaces of the front and rear panels 16 and 18 have glue applied thereto, such as latex. The worker that will mount the hanger tags 10 to the garment hangers 12 will retrieve each hanger tag in a flat configuration and insert the hook 12 of the garment hangar through the slot 21, and then fold the tag as illustrated in FIG. 1 so that its surfaces bearing the adhesive will mate together. This secures the hanger tag to the garment hanger.

Figure 2:
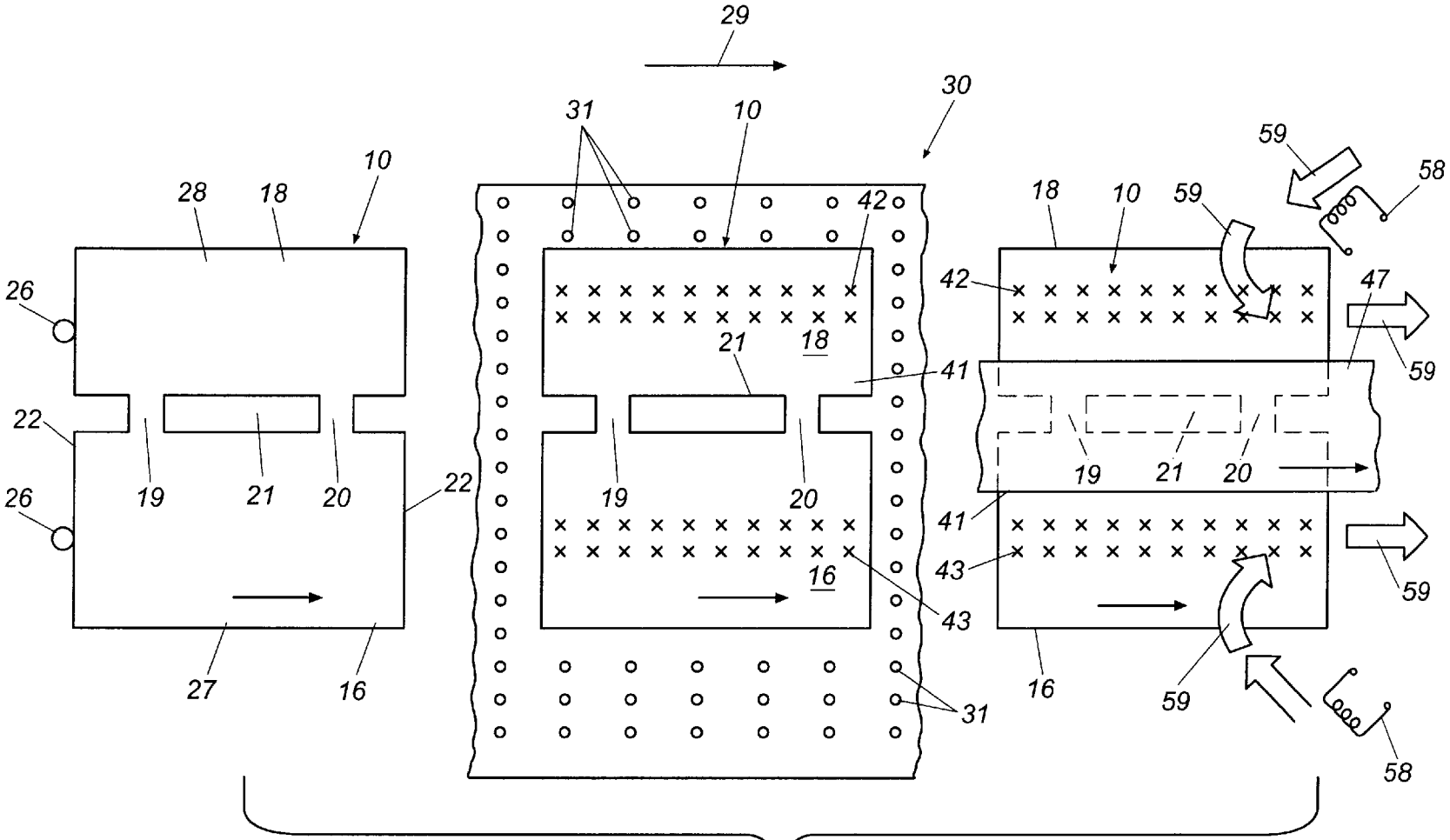
FIG. 2 is a plan view of a portion of the run of the multi-purpose glue applicator, showing the card stock as it is advanced on the vacuum conveyor beneath the glue applicator drum and later advanced by the dryer belts adjacent the heaters.
Figure 3:
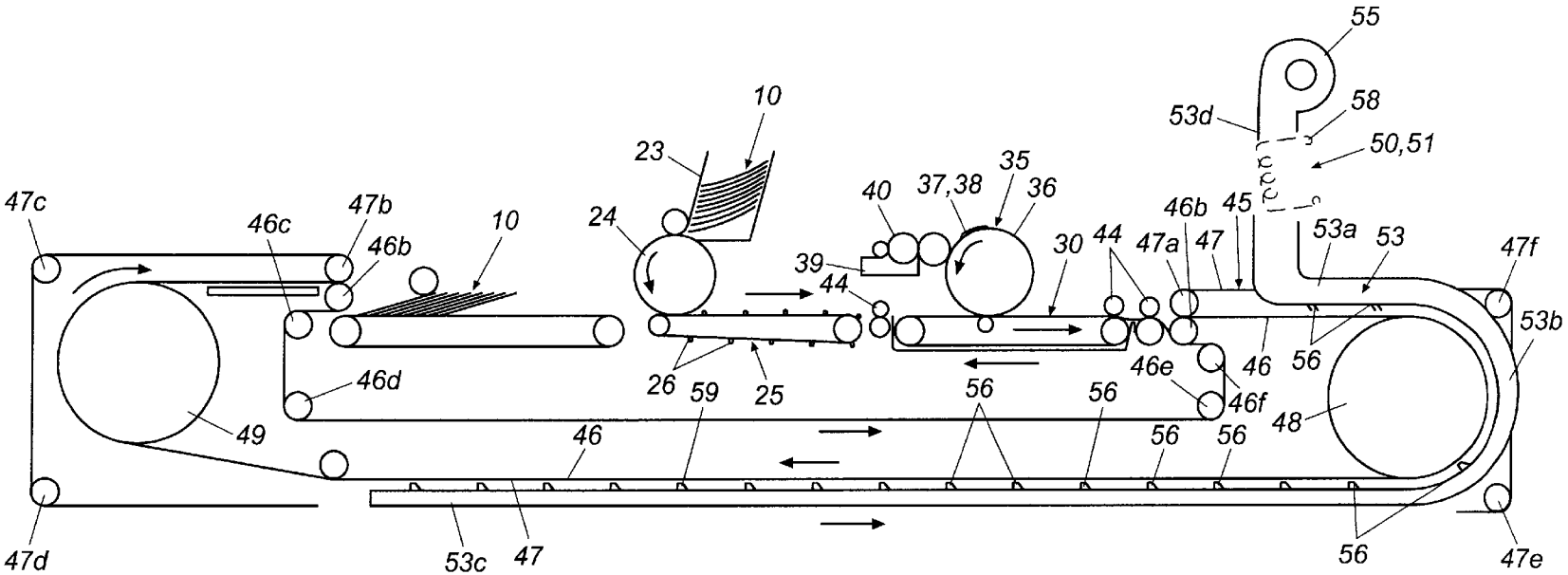
FIG. 3 is a schematic side elevational view of the multi-purpose glue applicator for sheet products.

FIGS. 2 and 3 illustrate the manner in which the glue is applied by the multi-purpose glue applicator to the hanger tags. As shown in FIG. 3, the hanger tags 10 are mounted in a feeder 23 and fed in sequence by a feed wheel 24 of conventional design to a pin conveyor 25. The pins 26 of the pin conveyor engage the trailing edges of each sheet product, assuring that the sheet products are properly positioned and are in timed relationship with the rest of the system.

As shown in FIG. 2, the example of a sheet product being handled by the multi-purpose gluer is a hanger tag of the type illustrated in FIG. 1. The ends 27 and 28 of the front and rear panels 16 and 18, respectively, are oriented from each other across the direction of movement as illustrated by the arrow 29, with the side edges 22 extending across the direction of movement. The pins 26 of the pin conveyor 25 engage a side edge 22.

The pin conveyor 25 advances each sheet product in sequence along the processing path to a conveyor, such as to the vacuum surface conveyor belt 30. Belt 30 includes an array of small air openings 31 for the passage of air therethrough, and the inlet of a blower 32 (FIG. 5) draws air through the belt, through duct 33, creating a vacuum beneath the belt. This causes the sheet products 10 to adhere to the surface of the vacuum belt and be advanced through the processing path in unison with the belt.

Glue applicator drum 35 is positioned over vacuum belt 30, and its cylindrical wall 36 is juxtaposed the upper run of the vacuum belt. Glue applicator strips 37 and 38 (FIGS. 4 and 5) are adhered to the cylindrical wall. A gum box 39 is positioned adjacent the glue applicator drum 35 and transfer rolls 40 apply glue from the gum box 39 to the glue applicator strips 37 and 38.

Figure 4:
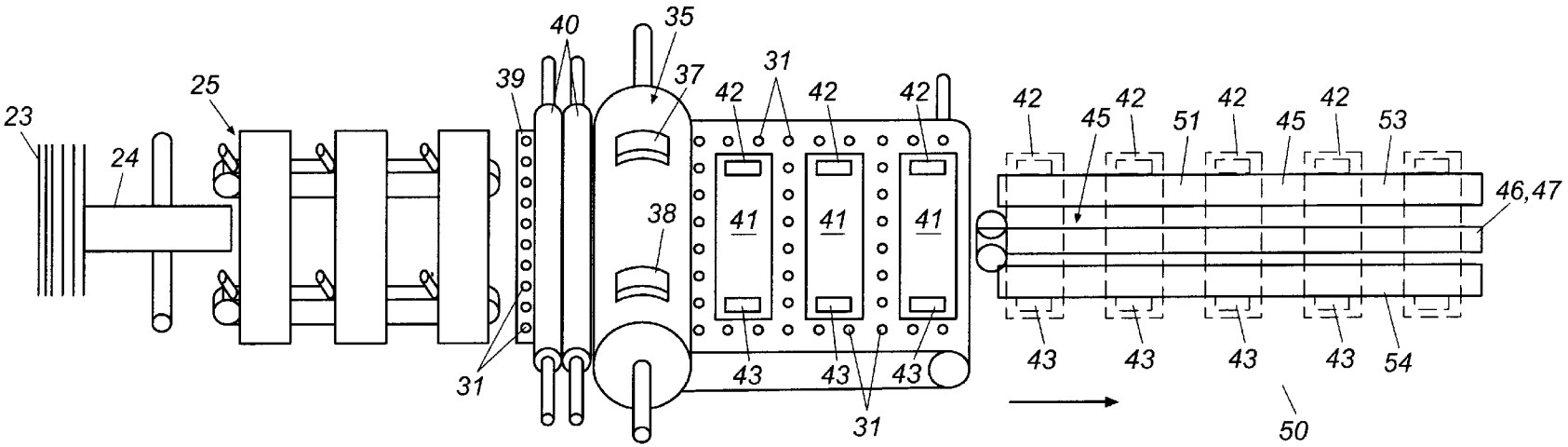
FIG. 4 is a schematic plan view of the multi-purpose glue applicator for sheet products.
Figure 5:
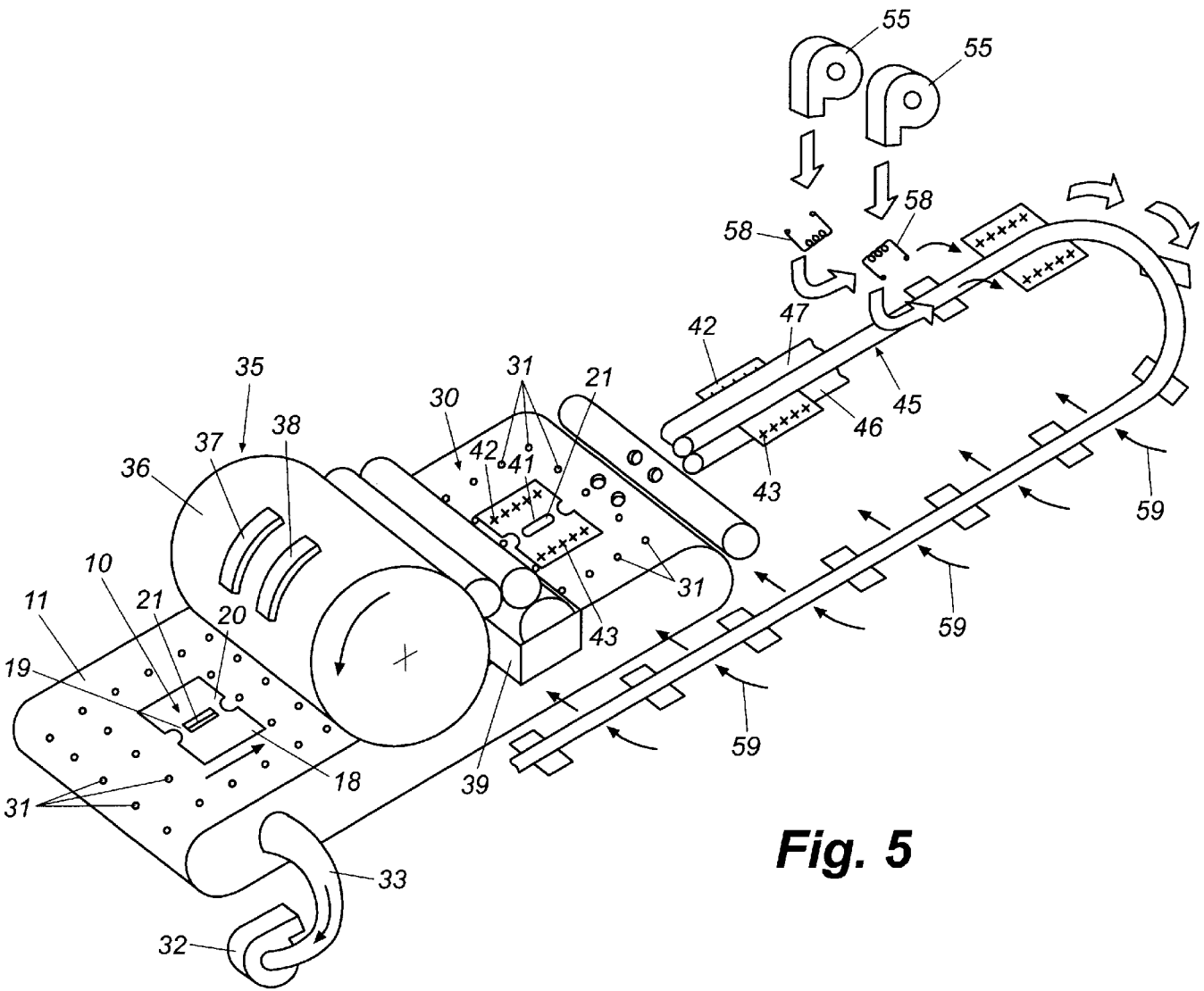
FIG. 5 is a perspective view of the multi-purpose glue applicator for sheet products.

As illustrated in FIGS. 4 and 5, the glue applicator strips 37 and 38 are positioned along the length of the glue applicator drum 35 at intervals so that they apply glue to the opposite ends of the sheet product. This leaves a belt engaging space 41 between the stripes 42 and 43 of glue on the surface of the sheet product. If the sheet product is the hanger tag shown in FIG. 1, the belt engaging space 41 will be located about the connector straps 19 and 20 and the slot 21 of the hanger tag, and the stripes of glue 42 and 43 will be spaced apart a distance sufficient to leave an unglued segment of the material that can extend about the shoulder bars 13 and 14 of a coat hanger 12.

After the glue stripes 42 and 43 have been applied to the sheet product, the sheet product is transferred to a dryer conveyor 45. Dryer conveyor 45 includes a pair of overlying conveyor belts 46 and 47 that move in unison along the processing path. The overlying belts come together about their respective guide rollers 46*a* and 47*a*, and move in unison about the larger guide rollers 48 and 49, and are separated at their rollers 46*b* and 47*b*, and are returned by their respective rollers 46*c*–46*f* and 47*c*–47*f*.

In order to assure that the sheet products are transferred from one conveyor to another without inadvertently changing the attitude of the sheet products, control rollers 44 can be used, as disclosed in detail in my U.S. Pat. No. 6,164,438, which is incorporated herein by reference.

As illustrated in FIG. 5, the guide belts 46 and 47 grasp the sheet products 10, such as the hanger tag, in the intermediate unglued belt engaging space 41, between the glue stripes 42 and 43. This leaves the glue stripes protruding laterally from between the conveyor belts, so that the belts avoid contacting the glue and the glue stripes on the sheet product are exposed for drying.

A pair of dryers 50, 51 are positioned in straddling relationship with respect to the dryer conveyor 45. Each dryer 50, 51 includes ducts 53, 54 respectively, with the ducts of the two dryers straddling the dryer conveyor, with each of the duct including segments, such as a horizontal run 53*a* extending adjacent the upper horizontal portion of the dryer conveyor, an arcuate run 53*b* extending about the large guide roller 48, and a lower horizontal run 53*c* extending adjacent the lower run of the overlying conveyor belt 46.

A vertical run such as run 53*d* of each duct communicates with the upper horizontal run 53*a*, and blowers 55 urge air downwardly through the vertical runs and along the subsequent runs such as runs 53*a*–53*c*.

Air exhaust nozzles 56 direct air from the ducts 53 toward the processing path of the stripes 42 and 43 of the glue on the sheet product traveling on opposite sides of the dryer conveyor 45. One or more induction heaters 58 are positioned in the ducts of each dryer 50, so as to increase the temperature of the air moving through the ducts, providing the air with increased drying capacity. The induction heaters can be positioned in the vertical runs 53*d* or in the horizontal runs 53*a* or 53*c*, as might be desired for controlling the temperature of the air. Therefore, the small streams of air 59 emitted from the air exhaust nozzles 56 are effective to dry the glue before the sheet products are moved about the return guide roller 59 and stacked at the end of the run of the dryer conveyor.

The glue applicator drum 35 is disclosed as a single drum; however, the glue applicator can be formed in smaller multiple segments that are driven on a common drive shaft, if desired.

The belt conveyor that transports the sheet products beneath the glue applicator drum is disclosed as a vacuum surface conveyor belt. However, other types of surface conveyor belt systems can be used if desired.

While the basic elements of the invention have been disclosed herein in order to teach the principle of the invention, it will be understood that there are other undisclosed standard elements of a glue applicator that are not illustrated or described herein that are required and are known to a person of ordinary skill in the art.

Although preferred embodiments of the invention have been disclosed in detail herein, it will be obvious to those skilled in the art that variations and modifications of the disclosed embodiments can be made without departing from the spirit and scope of the invention as set forth in the following claims.

What is claimed is:

1. A process of applying glue to sheet products comprising:

advancing a series of duplicate sheet products in equally spaced intervals in sequence along a processing path through a glue applicator station and a drying run, and as each sheet product is advanced through the glue applicator station:

placing the sheet product on a vacuum belt and drawing air through the vacuum belt to hold the product on the vacuum belt and advancing the vacuum belt and the sheet product in unison, while the sheet product is on the vacuum belt applying glue to the sheet product in spaced apart stripes extending along the path of the sheet product and leaving a belt engaging space on the sheet product without wet glue between the stripes, transferring the sheet product from the vacuum belt to the drying run, and as the sheet product moves through the drying run;

engaging the sheet product on opposed surfaces of the sheet product with a pair of overlying conveyor belts with one of the belts engaging the sheet product on the belt engaging space and leaving the glue stripes uncovered for drying, and directing heated air about the stripes of the sheet product protruding from the conveyor belt to dry the glue.

2. The process of applying glue to a sheet product of claim 1, wherein the sheet product is a hangar tag with first and second body portions connected together by spaced straps, and the step of applying stripes of glue to the sheet product comprises:

applying one stripe of glue to one body portion of the hangar tag and applying the other stripe of glue to the other body portion of the hangar tag with the straps of the of the hangar tag positioned in the belt engaging space between the stripes of glue, so that the straps of the hangar tag can be positioned in straddling relationship about the hook of a garment hangar and the stripes of glue can be folded about the shoulder bar of the garment hangar and joined together.

3. The process of applying glue to a sheet product of claim 1, wherein the glue applied to the sheet product is selected from a group consisting of: latex, remoistenable glue, and pressure sensitive glue with release liner.

4. The process of applying adhesive to a sheet product of claim 1, wherein the step of directing heated air about the stripes of the sheet product comprises directing a first series of streams of heated air about one stripe and directing a second series of streams of heated air about the other stripe.

5. A process of applying glue to sheet products comprising:

advancing a series of duplicate sheet products in equally spaced intervals in sequence along a processing path through a glue applicator station and a drying run, and as each sheet product is advanced through the glue applicator station:

simultaneously applying glue to the sheet product in spaced apart stripes extending along the path of the sheet product and leaving a belt engaging space on the sheet product without wet glue between the stripes, as the sheet product moves through the drying run:

engaging the sheet product on opposed surfaces of the sheet product with a pair of overlying conveyor belts with one of the belts engaging the sheet product on the belt engaging space and leaving the glue stripes uncovered for drying, and directing heated air about the stripes of the sheet product protruding from the conveyor belt to dry the glue.

6. A process of applying glue to sheet products comprising:

advancing a series of duplicate sheet products in equally spaced intervals in sequence along a processing path through a glue applicator station and a drying run, and as each sheet product is advanced through the glue applicator station:

placing the sheet product on a vacuum belt and drawing air through the vacuum belt to hold the product on the vacuum belt and advancing the vacuum belt and the sheet product in unison, while the sheet product is on the vacuum belt applying glue to the sheet product in spaced apart stripes extending along the path of the sheet product and leaving a belt engaging space on the sheet product without wet glue between the stripes, transferring the sheet product from the vacuum belt to the drying run, and as the sheet product moves through the drying run:

engaging the sheet product on opposed surfaces of the sheet product with a pair of overlying conveyor belts with one of the belts engaging the sheet product on the belt engaging space and leaving the glue stripes uncovered for drying, and directing heated air about the stripes of the sheet product protruding from the conveyor belt to dry the glue.

7. A process for applying glue to sheet products, comprising:

advancing a plurality of the sheet products in series along the processing path with opposed sides of the sheet product extending across the direction of advancement of the sheet product, simultaneously applying stripes of glue to the sheet product with the stripes of glue spaced from each other and leaving therebetween a belt engaging space without wet glue applied thereto, after the glue stripes have been applied to the sheet product and before the glue stripes have dried, engaging the sheet product at the belt engaging space between the glue stripes with a conveyor and advancing the sheet product with the conveyor along a drying path with the glue stripes straddling the conveyor, as the sheet product is advanced along the drying path, applying a series of streams of heated air on each side of the conveyor to each of the glue stripes.

* * * * *